US009900675B2

(12) United States Patent
Papakyriacou et al.

(10) Patent No.: US 9,900,675 B2
(45) Date of Patent: *Feb. 20, 2018

(54) PACKAGING OF ACOUSTIC VOLUME INCREASING MATERIALS FOR LOUDSPEAKER DEVICES

(71) Applicant: Sound Solutions International Co., Ltd.

(72) Inventors: Maria Papakyriacou, Vienna (AT); Markus Steinhauser, Karnabrunn (AT); Thomas Jagsich, Vienna (AT)

(73) Assignee: Sound Solutions International Co., Ltd., Beijing (CN)

( * ) Notice: Subject to any disclaimer, the term of this patent is extended or adjusted under 35 U.S.C. 154(b) by 292 days.

This patent is subject to a terminal disclaimer.

(21) Appl. No.: 14/728,595

(22) Filed: Jun. 2, 2015

(65) Prior Publication Data

US 2015/0271579 A1 Sep. 24, 2015

Related U.S. Application Data

(63) Continuation of application No. 14/003,217, filed as application No. PCT/EP2012/053719 on Mar. 5, 2012, now Pat. No. 9,099,073.

(30) Foreign Application Priority Data

Mar. 4, 2011 (EP) ..... 11157097

(51) Int. Cl.

| | |
|---|---|
| ***H04R 1/22*** | (2006.01) |
| ***H04R 1/02*** | (2006.01) |
| ***H04R 1/28*** | (2006.01) |
| ***G10K 11/00*** | (2006.01) |
| ***H04R 31/00*** | (2006.01) |
| *H04R 1/20* | (2006.01) |

(52) U.S. Cl.

CPC ..... *H04R 1/02* (2013.01); *G10K 11/002* (2013.01); *H04R 1/025* (2013.01); *H04R 1/2803* (2013.01); *H04R 31/00* (2013.01); *Y10T 29/49227* (2015.01)

(58) Field of Classification Search

CPC ..... H04R 1/02; H04R 1/025; H04R 1/2803; H04R 1/2869; H04R 1/22; G10K 11/002

USPC ..... 181/199, 151; 381/354

See application file for complete search history.

(56) References Cited

U.S. PATENT DOCUMENTS

| | | | | |
|---|---|---|---|---|
| 4,657,108 | A * | 4/1987 | Ward | H04R 1/2803 181/149 |
| 6,716,276 | B2 | 4/2004 | Loop et al. | |
| 7,390,351 | B2 | 6/2008 | Leir et al. | |
| 7,743,877 | B2 | 6/2010 | Saiki et al. | |
| 7,953,240 | B2 | 5/2011 | Matsumura et al. | |
| 8,184,826 | B2 | 5/2012 | Matsumura et al. | |
| 8,265,330 | B2 | 9/2012 | Fukunishi et al. | |
| 8,794,373 | B1 | 8/2014 | Lin | |

(Continued)

*Primary Examiner* — Edgardo San Martin

(74) *Attorney, Agent, or Firm* — Steven McMahon Zeller Dykema Gossett PLLC

(57) ABSTRACT

There is provided an acoustic element for placement in a sound path of a loudspeaker device, the acoustic element comprising a container and an acoustic volume increasing material located in the container. In an embodiment, the container comprises wall portions with different physical characteristics. In other embodiments, the walls of the container are made of the same material.

30 Claims, 2 Drawing Sheets

(56) References Cited

U.S. PATENT DOCUMENTS

| | | | | |
|---|---|---|---|---|
| 8,885,863 | B2 | 11/2014 | Takashima et al. | |
| 8,942,402 | B2 | 1/2015 | Yuasa | |
| 9,099,073 | B2 * | 8/2015 | Papakyriacou | H04R 1/2803 |
| 9,648,403 | B2 * | 5/2017 | Papakyriacou | H04R 1/02 |
| 2007/0127760 | A1 | 6/2007 | Saiki et al. | |
| 2007/0165895 | A1 * | 7/2007 | Matsumura | H04R 1/2803 381/351 |
| 2007/0195982 | A1 | 8/2007 | Saiki et al. | |
| 2007/0286449 | A1 | 12/2007 | Matsumura et al. | |
| 2008/0149418 | A1 * | 6/2008 | Imamura | H04R 1/288 181/199 |
| 2009/0028370 | A1 | 1/2009 | Matsumura et al. | |
| 2009/0245562 | A1 | 10/2009 | Saiki et al. | |
| 2009/0316920 | A1 * | 12/2009 | Matsumura | H04R 1/2803 381/59 |
| 2010/0074463 | A1 * | 3/2010 | Fukunishi | H04R 1/2803 381/386 |
| 2010/0135516 | A1 | 6/2010 | Saiki et al. | |
| 2011/0048844 | A1 | 3/2011 | Papakyriacou | |
| 2013/0341118 | A1 | 12/2013 | Papakyriacou et al. | |
| 2015/0271579 | A1 * | 9/2015 | Papakyriacou | H04R 1/2803 181/199 |

* cited by examiner

PACKAGING OF ACOUSTIC VOLUME INCREASING MATERIALS FOR LOUDSPEAKER DEVICES

CROSS REFERENCE TO RELATED APPLICATIONS

This application is a continuation of U.S. patent application Ser. No. 14/003,217, filed Sep. 4, 2013, which is a national stage of PCT/EP2012/053719, filed Mar. 5, 2012, which claims priority to European Patent Application No. 11157097.4 filed Mar. 4, 2011, the disclosures of which are incorporated in their entirety by reference herein.

FIELD OF THE INVENTION

The present invention relates to the field of loudspeaker devices and in particular to miniature loudspeaker devices.

ART BACKGROUND

In loudspeaker devices an acoustically active material may be placed in a back volume of the loudspeaker device so as to virtually enlarge the back volume. Such an acoustically active material may be an acoustic volume increasing material which virtually enlarges the back volume. Hence, by use of an acoustically active material the resonance frequency of the loudspeaker device is lowered to a value that can be achieved without acoustically active material only with an essentially larger back volume.

EP 2 003 924 A1 discloses a molded gas adsorber obtained by adding a binder to a porous material including a plurality of grains, thereby forming widened spaces among the grains of the porous material as compared to a conventional gas adsorber including no binder. The binder is provided in the form of a powdery resin material or a fibrous resin material.

Forming a molded gas adsorber that provides good adsorption/desorption characteristics from grains of porous material and powdery resin material or fibrous resin material may be difficult and expensive.

In view of the above described situation, there exists a need for an improved technique that enables to provide an acoustic element while substantially avoiding or at least reducing one or more of the above-identified problems.

SUMMARY OF THE INVENTION

According to a first aspect of the herein disclosed subject-matter, there is provided an acoustic element for placement in a sound path of a loudspeaker device, the acoustic element comprising a container and an acoustic volume increasing material located in the container.

This aspect of the herein disclosed subject-matter is based on the idea that providing an acoustic element that is capable of increasing the acoustic volume is facilitated by providing acoustic volume increasing material in a container.

It should be understood that the acoustic volume increasing material does not increase the space available in a device for acoustic purposes. Rather, the virtual volume sensed by the loudspeaker is increased as is well known in the art. The increased acoustic (virtual) volume leads to a decreased lower resonance frequency of the loudspeaker device compared to the loudspeaker device without volume increasing material.

A sound path may be any sound path extending from the loudspeaker, e.g. a backward sound path or a lateral sound path. For example a backward sound path in the sense of the herein disclosed subject matter is a sound path that extends from the back side of a loudspeaker mounted in the loudspeaker device. As usual, the back side of the loudspeaker is a side opposite the sound radiation side from which sound is radiated into the surrounding of the loudspeaker device.

According to an embodiment, the container comprises a first wall portion and a second wall portion having a characteristic, e.g. a physical characteristic, different from the respective characteristic of the first wall portion. For example, in an embodiment the sound transmissibility of the first wall portion is higher than the sound transmissibility of the second wall portion. For example, the first wall portion may be formed of a material that is sound-transparent, whereas the second wall portion may be formed of any other material which is suitable as wall material for a container as disclosed herein but which has a reduced sound transmissibility compared to the first wall portion.

According to other embodiments, the first wall portion and the second wall portion have similar or identical characteristics.

According to a further embodiment, the second wall portion is formed of a molded element. For example, in an embodiment, the molded element is a deep drawn element, a thermo-formed element, an injection-molded element, etc. In an embodiment, the first wall portion is attached to the molded element forming the second wall portion.

According to a further embodiment, the second wall portion is cup-shaped having an opening and the first wall portion closes the opening. Hence, in an embodiment the second wall portion determines the overall shape of the acoustic element. The first wall portion may be provided for a transfer of the sound to the acoustic volume increasing material. This provides flexibility in regard to the shape and the material of the second wall portion.

In fabrication, according to an embodiment, the acoustic volume increasing material is placed into the cup-shaped second wall portion and thereafter the opening of the second wall portion is closed by the first wall portion. In a further embodiment, the first wall portion seals the opening of the second wall portion. For example, in the case of a granular acoustic volume increasing material (i.e. an acoustic volume increasing material comprising or consisting of loose particles) the sealing first wall portion prevents falling out of the particles. It should however be mentioned that "sealing" in this regard means that the falling out of the particles is prevented, while transmission of the sound into the container and out of the container is still possible.

According to a further embodiment, the container has a predetermined three-dimensional shape. For example, such a predetermined three-dimensional shape may be provided by a cup-shaped wall portion as described above. According to other embodiments, the predetermined three-dimensional shape may also be obtained by using a single wall material by a respective cut of the wall material and appropriate joining of the edges of the cut wall material.

As mentioned, the container comprises a container wall that encloses a volume containing the acoustic volume increasing material, wherein the container wall is formed of a single wall material. Forming the container of a single wall material provides for a very cost-efficient and easy manufacturing process. For example, containers of this type can be produced using similar packaging technologies such as is known for tea bags, sugar bags, coffee pads and coffee tabs, etc.

For example, in an embodiment the container wall is formed of a single sheet of the wall material and the single sheet of the wall material is folded to form the container.

According to a further embodiment, the container is at least partially formed of a filter material e.g. a fiber material having passages between the fibers that allow for a gas exchange through the fiber material, or a sieve or a mesh. For example, in an embodiment the single sheet of wall material is formed of such a fiber material. In another embodiment, the first wall portion of the container is formed of the fiber material. The fiber material may be formed of a cloth formed of fibers or may be formed of metal ceramics, plastic, and may be e.g. a woven fabric or a fleece, paper, etc. For example, the filter material may be a material as disclosed in the European Patent Application No. 09 169 178.2 (corresponding to U.S. patent application Ser. No. 12/873,782).

According to an embodiment, the acoustic volume increasing material is an electrically insulating material. In this way, interference with electrical currents and electromagnetic fields, which are present in various devices, can be avoided or at least reduced.

According to an embodiment, the acoustic volume increasing material comprises or consists of the loose particles. In such a case, the container may provide for a predetermined spatial distribution of the particles, the distribution being determined by the shape of the container. For example, in an embodiment, the acoustic volume increasing material is a material as disclosed in the European patent application No. 10 173 765.8 (corresponding to U.S. patent application Ser. No. 13/818,374).

In an embodiment the fiber material is be adapted to the particle size, e.g. to provide a good sound transparency and a low sound resistance while still ensuring the containment of the acoustic volume increasing material.

According to other embodiments, the acoustic volume increasing material comprises or consists of fibers, a fleece, etc. of respective acoustically active materials. An advantage of embodiments of the container is the containment of the acoustic volume increasing material itself and/or the containment of abraded particles of the acoustic volume increasing material.

An acoustic volume increasing material in the form of an electrically insulating material has further advantages if the acoustic volume increasing material is provided in the form of loose particles.

However, according to other embodiments of the herein disclosed subject-matter the acoustic volume increasing material includes or consists of an electrically conducting material, such as activated carbon.

According to a second aspect of the herein disclosed subject-matter, a loudspeaker device is provided, the loudspeaker device comprising an acoustic element according to the first aspect or an embodiment thereof.

For example, according to an embodiment, the loudspeaker device comprises a housing, the housing having a loudspeaker receptacle for receiving a loudspeaker and a sound path, e.g. a back volume, extending from the loudspeaker receptacle, wherein the container is placed in the sound path. In a further embodiment, the loudspeaker device comprises a loudspeaker mounted in the loudspeaker receptacle.

In a further embodiment, the shape of the container matches the shape of the back volume. This allows for a maximum filling of the back volume with the acoustic volume increasing material.

According to a third aspect of the herein disclosed subject-matter, there is provided a method of placement of an acoustic element in a sound path of a loudspeaker device, the method comprising providing a container, filling the acoustic volume increasing material into the container; and placing the container in the sound path.

It should be understood, that the container and the acoustic volume increasing material may be configured in accordance with embodiments of the herein disclosed subject-matter.

In the above there have been described and in the following there will be described exemplary embodiments of the subject-matter disclosed herein with reference to an acoustic element, a loudspeaker device and a method of placing an acoustic element in a loudspeaker device. It has to be pointed out that of course any combination of features relating to different aspects of the herein disclosed subject-matter is also possible. In particular, some embodiments have been described or will be described with reference to an apparatus, whereas other embodiments have been or will be described with reference to a method. However, a skilled person will gather from the above and the following description that, unless otherwise notified, in addition to any combination of features belonging to one aspect also any combination between features relating to different aspects or embodiments, for example even between features relating to an apparatus and features relating to a method, is considered to be disclosed with this application. The aspects and embodiments defined above and further aspects and embodiments of the herein disclosed subject-matter are apparent from the examples to be described hereinafter and are explained with reference to the drawings but to which the invention is not limited.

DETAILED DESCRIPTION

Figure 1:
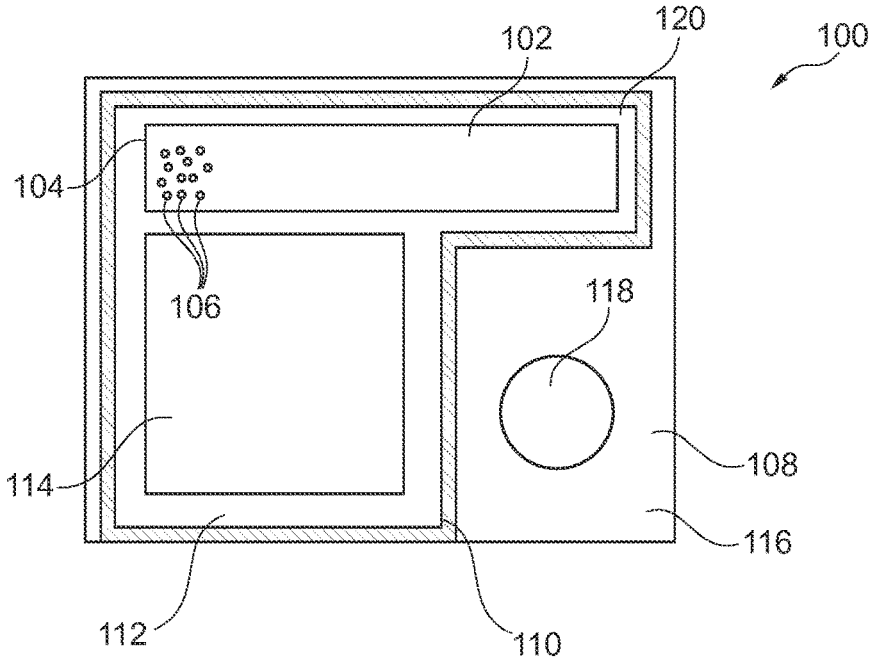
FIG. 1 shows a cross-sectional view of a loudspeaker device in accordance with embodiments of the herein disclosed subject-matter.

The illustration in the drawings is schematic. It is noted that in different figures, similar or identical elements are provided with the same reference signs or with reference signs which are different from the corresponding reference signs only within the first digit or an appended character.

Acoustically active materials, i.e. acoustic volume increasing materials, can be used in the back volume of a loudspeaker device to improve the sound, e.g. the wideband performance, and/or to increase the acoustic volume of the loudspeaker and save space. Such acoustically active materials include zeolite materials or zeolite-based materials.

Such electrically isolating materials are superior to conventional acoustically active materials like activated carbon, because they are electrically non-conductive and hence do not influence an antenna, a battery effect or bear the risk of short circuits. Furthermore, packaging of these materials is much easier than in case of activated carbon woven fabrics.

A problem may arise in insertion of the materials consisting or at least comprising loose particles, in the back volume of the loudspeaker device. Furthermore, the back volume of a miniature loudspeaker, such as a loudspeaker device placed in mobile phones, headsets, etc., is often built up by the surrounding area of the loudspeaker and is not well-defined. A direct insertion of the acoustically active materials into the surrounding area is practically difficult. Furthermore, the acoustically active materials can enter into the different components of the device having included the loudspeaker device and also in the loudspeaker itself and can therefore damage the device or the loudspeaker.

Embodiments of the herein disclosed subject-matter overcome these disadvantages by enclosing acoustically active materials in a container. This simplifies mounting and provides additionally a protection of the loudspeaker and the remaining device.

FIG. 1 shows a loudspeaker device in accordance with embodiments of the herein disclosed subject-matter. The loudspeaker device 100 comprises an acoustic element 102 in accordance with embodiments of the herein disclosed subject-matter. The acoustic element 102 includes a container 104 and an acoustic volume increasing material 106 in the form of loose particles in the container 104. It should be noted that only a few particles 106 are shown in FIG. 1 and that usually the container will be filled to a large extent or may be completely filled with the acoustic volume increasing material. The loudspeaker device 100 further comprises a housing including a base plate 108 and a wall structure 110. The wall structure 110 separates a loudspeaker receptacle 112 which has mounted thereon a loudspeaker 114, and a microphone receptacle 116 which has mounted thereon a microphone 118.

The wall structure 110 further defines a back volume 120 in which the acoustic element 102 is located. In an embodiment, the size and the shape of the acoustic element 102 matches the size and the shape of the back volume, thereby providing for a maximum filling level of the back volume.

It should however be noted, that the configuration shown in FIG. 1 is only exemplary and that other loudspeaker devices may not include a microphone receptacle or a microphone. Further, the back volume is, in another embodiment, not defined by a wall structure but only by surrounding components which surround the loudspeaker 114 in a device in which the loudspeaker is mounted. Such a device may be for example a mobile phone, a headset, etc. In such applications, the loudspeaker device may be a miniature loudspeaker device.

The acoustic element 102 may be configured in accordance with one or more embodiments disclosed herein.

Figure 2:
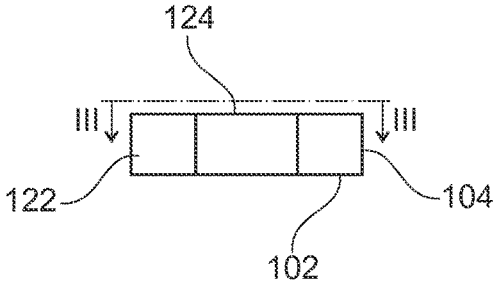
FIG. 2 shows a side view of an acoustic element in accordance with embodiments of the herein disclosed subject-matter.

FIG. 2 shows a side view of an acoustic element in accordance with embodiments of the herein disclosed subject-matter. The acoustic element 102 is made of a container 104 which has a cup-shaped second wall portion 122 and, as a cover of the second wall portion 122, a first wall portion 124 which has a high sound transmissibility. Hence, while in an embodiment the cup-shaped second wall portion 122 serves as a receptacle for receiving the acoustic volume increasing material (not shown in FIG. 2), the first wall portion 124 serves to couple sound from the loudspeaker into the container and into the acoustic volume increasing material. For example, in an embodiment the second wall portion 122 is made of a plastic whereas the first wall portion 124 is made of for example a fiber material, such as a sound transparent fleece or a foam being capable of passing the sound through the first wall portion.

According to an embodiment, cup-shaped second wall portion 122 is a rigid structure. Such a rigid structure guaranties a good mounting ability and robustness.

Figure 3:
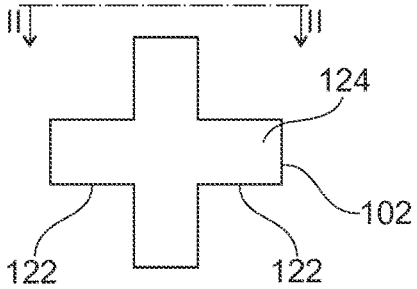
FIG. 3 shows a top view of the acoustic element 102 viewed from line III-III in FIG. 2.

FIG. 3 shows a top view of the acoustic element 102 viewed from line III-III in FIG. 2. The side view of FIG. 2 in turn is obtained when viewing the acoustic element 102 from line II-II in FIG. 3.

As can be seen from FIG. 3, the container 104 may have a predetermined three-dimensional shape. According to an embodiment, a three dimensional (3D) container (bag) having on all sides the "sound transparent" material is provided. The shape of such a 3D geometry means that a more complex geometry is evident not only in the xy direction (drawing plane in FIG. 3) but also in the z direction. The 3D container has the advantage that it can fill a complex shaped back cavity more efficiently than the simple rectangular bags, which are however also in the scope of exemplary embodiments of the herein disclosed subject matter.

In an alternative embodiment, the container 104 or at least a container wall is made from a single type of material. For example, the shape shown in FIG. 2 and FIG. 3 may also be obtained by only using a fiber material of suitable shape.

Figure 4:
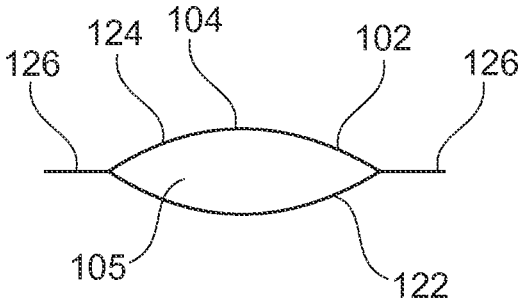
FIG. 4 shows a further acoustic element 102 in cross-sectional view in accordance with embodiments of the herein disclosed subject-matter.

FIG. 4 shows a further acoustic element 102 in cross-sectional view in accordance with embodiments of the herein disclosed subject-matter. The acoustic element 102 in FIG. 4 is made of a single type of wall material. In particular, the container 104 of the acoustic element 102 in FIG. 4 is made of two wall portions 124, 122 which are both made of a wall material of the same type. To obtain the container 104, an upper wall portion 124 and a lower wall portion 122 are attached together at overlapping edge sections 126 of the wall portions 124, 122. The wall portions 124, 122 enclose a cavity 105 that is filled with the acoustic volume increasing material (not shown in FIG. 4).

Figure 5:
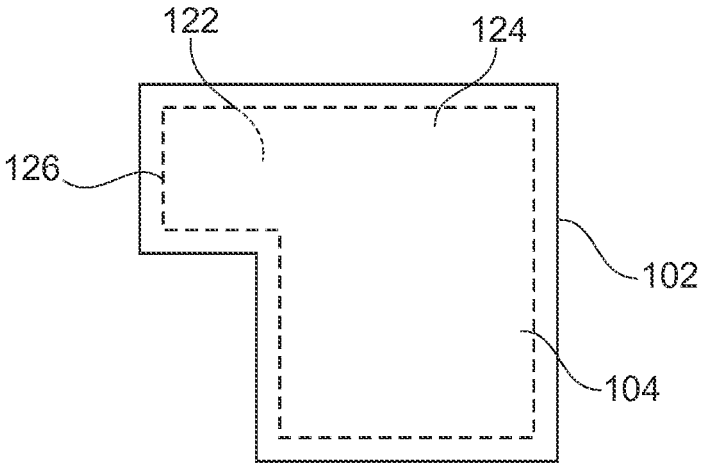
FIG. 5 shows a top view of an acoustic element 102 in accordance with embodiments of the herein disclosed subject-matter.

FIG. 5 shows a top view of an acoustic element 102 in accordance with embodiments of the herein disclosed subject-matter. As shown in FIG. 5, a container comprising container walls being formed of a single type of material may also be formed in more complicated shapes as shown in FIG. 5. Again an upper wall portion 124 and a lower wall portion 122 are attached to each other at an edge portion 126.

However, the shape shown in FIG. 5 may be realized by any other suitable configuration of the wall portions and attachment methods.

According to an embodiment, the upper wall portion 124 and the lower wall portion 122 as described herein may be attached to each other by gluing, crimping, stamping, embossing, heat sealing or the like.

Figure 6:
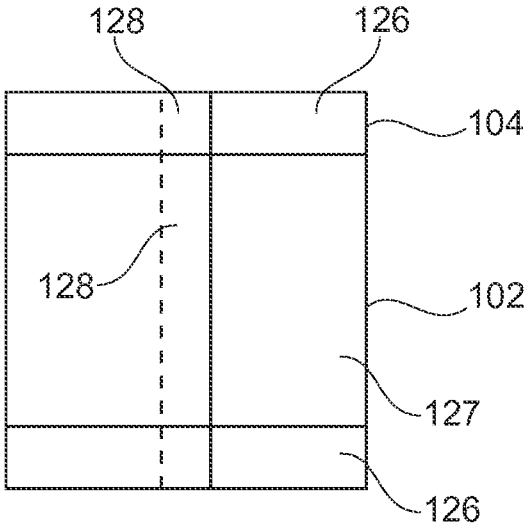
FIG. 6 shows a further acoustic element 102 in accordance with embodiments of the herein disclosed subject-matter.

FIG. 6 shows a further acoustic element 102 in accordance with embodiments of the herein disclosed subject-matter. The container 104 of the acoustic element 102 shown in FIG. 6 is made of a single sheet 127 of wall material. The single sheet 127 of wall material is folded to form the container 104. Hence, there is a vertical overlapping region 128 and two edge portions 126 where an upper wall portion overlaps a lower wall portion of the single sheet 127 of wall material.

The edge portions 126 of the containers 104 shown in FIG. 4, FIG. 5 and FIG. 6 may have formed the edge portions 126 in the form of seams. The overlapping region 128 is preferably positioned at a side opposite a first side which faces the loudspeaker, since the overlapping region may have a reduced sound transparency.

Generally in accordance with embodiments of the herein disclosed subject matter, a single wall portion, two or more wall portions, or all wall portions of the container may be of sound transparent material.

It should be noted that any entity disclosed herein (e.g. the acoustic element, the container, the loudspeaker device, etc.) are not limited to a dedicated entity as described in some embodiments. Rather, the herein disclosed subject matter may be implemented in various ways and with arbitrary granularity on device level while still providing the desired functionality. Further, it should be noted that according to embodiments a separate entity may be provided for each of the functions disclosed herein. According to other embodiments, an entity is configured for providing two or more functions as disclosed herein.

It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

In order to recapitulate the above described embodiments of the present invention one can state:

There is provided an acoustic element for placement in a sound path of a loudspeaker device, the acoustic element comprising a container and an acoustic volume increasing material located in the container. In an embodiment, the container comprises wall portions with different physical characteristics. In other embodiments, the walls of the container are made of the same material.

LIST OF REFERENCE SIGNS

100 loudspeaker device
102 acoustic element
104 container
105 cavity
106 acoustic volume increasing material
108 base plate
110 wall structure
112 loudspeaker receptacle
114 loudspeaker
116 microphone receptacle
118 microphone
120 back volume
122 second wall portion
124 first wall portion
126 edge portion
127 single sheet
128 overlapping region

What is claimed is:

1. An acoustic element for virtually enlarging the back volume of an acoustic device, the acoustic element comprising:

a dimensionally stable container structure formed from a single piece of gas impermeable material and having a base wall and sidewalls, wherein the base wall and the sidewalls define an open chamber, the top of the sidewalls further comprising an edge portion;

a predefined amount of loose zeolite-based sound adsorber granules disposed within the chamber; and a gas permeable cover attached to the edge portion of the container structure to retain the sound adsorber granules within the chamber;

wherein the low acoustic resistance of the cover facilitates gas transfer between the back volume and the chamber so gas in the back volume can interact with the zeolite-based sound adsorber granules disposed within the chamber; and wherein the exterior surfaces of the base wall and sidewalls of the container structure substantially match the interior surfaces of a predetermined portion of the back volume of the acoustic device in three axes.

2. The acoustic element according to claim 1, wherein the container structure is formed by a deep-drawn process, an injection molding process, or a thermo-forming process.

3. The acoustic element according to claim 1, wherein the cover is mechanically attached to the edge portion of the container structure by gluing, crimping, stamping, embossing, or heat-sealing.

4. The acoustic element according to claim 1, wherein the chamber of the container structure is partially filled with the zeolite-based sound adsorber granules.

5. The acoustic element according to claim 1, wherein the chamber of the container structure is substantially filled with the zeolite-based sound adsorber granules.

6. The acoustic element according to claim 1, wherein the sound transmissibility of the cover is greater than the sound transmissibility of the container structure.

7. The acoustic element according to claim 1, wherein the cover has low acoustic resistance and comprises one or more of a filter material, a fleece material, a foam material, a sieve material, a mesh material, or a cloth fabric formed from fibers.

8. The acoustic element according to claim 7, wherein pores of the material of the cover are adapted to be less that size of the sound adsorber granules.

9. The acoustic element according to claim 1, wherein the shape of the acoustic element provides a predetermined spatial distribution of the sound adsorber granules within the back volume of the acoustic device.

10. The acoustic element according to claim 1, wherein the external surfaces of at least a portion of the cover of the acoustic element are configured to substantially match the interior surfaces of a predetermined portion of the back volume of the acoustic device.

11. A loudspeaker device housing comprising:

a loudspeaker receptacle for receiving a loudspeaker and a back volume extending from the loudspeaker receptacle; and an acoustic element according to claim 1 disposed in the back volume.

12. An acoustic package for virtually enlarging the back volume of an acoustic device, the acoustic package comprising:

a dimensionally stable unitary container element manufactured from gas impermeable material and comprising side portions disposed on a base portion, the side portions and base portion defining an open chamber, wherein the side portions have an attachment portion spaced away from the base portion, wherein the exterior surfaces of the base portion and the side portions are configured to substantially align with a predefined portion of the interior surfaces defining the back volume;

a predefined amount of loose zeolite-based sound adsorber granules disposed within the chamber; and a cover element manufactured from gas-permeable material and attached to the attachment portion on the sidewall portions of the container element to retain the loose sound adsorber granules within the chamber;

wherein the chamber is substantially filled with the sound adsorber granules; and wherein the exterior surfaces of the cover element substantially align with the interior surfaces of a predefined portion of the back volume.

13. The acoustic package according to claim 12, wherein the container element is formed by a deep-drawn process, an injection molding process, or a thermo-forming process.

14. The acoustic package according to claim 12, wherein the cover element is mechanically attached to the attachment portion of the container element by gluing, crimping, stamping, embossing, or heat-sealing.

15. The acoustic package according to claim 12, wherein the sound transmissibility of the cover element is greater than the sound transmissibility of the container element.

16. The acoustic package according to claim 12, wherein the cover element has low acoustic resistance and comprises one or more of a filter material, a fleece material, a foam material, a sieve material, a mesh material, or a fiber-based cloth fabric.

17. The acoustic package according to claim 16, wherein openings of the material of the cover element are adapted to be less than the size of the sound adsorber granules.

18. The acoustic package according to claim 12, wherein the shape of the acoustic package provides a predetermined spatial distribution of the sound adsorber granules within the back volume of the acoustic device.

19. The acoustic package according to claim 12, wherein the cover element facilitates gas transfer between the back volume and the chamber based on the acoustic pressure in the back volume so gas in the back volume can interact with the sound adsorber granules disposed within the chamber, and wherein the container element portion substantially inhibits gas transfer between the back volume and the chamber.

20. A loudspeaker device housing comprising:

a loudspeaker receptacle for receiving a loudspeaker and a back volume extending from the loudspeaker receptacle; and an acoustic package according to claim 12 disposed in the back volume.

21. An acoustic insert for placement within the back volume of an acoustic device, the acoustic insert comprising:

a three-dimensional canister element manufactured from a single piece of material and comprising a continuous sidewall portion disposed on a base portion, wherein the continuous sidewall portion and the base portion cooperate to define an open cavity with a predefined volume, and wherein the upper end of the continuous sidewall portion has a cover mounting portion spaced away from the base portion;

an amount of loose, electrically non-conductive, zeolite-based sound adsorber granules disposed in the open cavity; and a cover element attached to the attachment portion on the sidewall portion of the canister element, thereby sealing the open cavity defined by the sidewall portion and base portion of the canister element;

wherein a sound transmissibility characteristic of the cover element material is greater than a sound transmissibility characteristic of the canister element material such that the cover element facilitates gas exchange between the back volume and the cavity of the canister element, thereby allowing gas in the back volume to interact with the zeolite-based sound adsorber granules disposed within the cavity.

22. The acoustic insert according to claim 21, wherein the canister element is formed by a deep-drawn process, an injection molding process, or a thermo-forming process.

23. The acoustic insert according to claim 21, wherein the cover element is mechanically attached to the cover mounting portion of the container element by gluing, crimping, stamping, embossing, or heat-sealing.

24. The acoustic insert according to claim 21, wherein the cavity of the container element is partially filled with the zeolite-based sound adsorber granules.

25. The acoustic insert according to claim 21, wherein the cavity of the container element is substantially filled with the zeolite-based sound adsorber granules.

26. The acoustic package according to claim 21, wherein the cover element has low acoustic resistance and comprises one or more of a filter material, a fleece material, a foam material, a sieve material, a mesh material, or a fiber-based cloth fabric.

27. The acoustic package according to claim 26, wherein pores of the material of the cover element are adapted to be less than the size of the loose sound adsorber granules.

28. The acoustic insert according to claim 21, wherein the shape of the acoustic element provides a predetermined spatial distribution of the zeolite-based sound adsorber granules within the back volume of the acoustic device.

29. A loudspeaker device housing comprising:

a loudspeaker receptacle for receiving a loudspeaker and a back volume extending from the loudspeaker receptacle; and an acoustic insert according to claim 21 disposed in the back volume.

30. A loudspeaker device comprising:

a housing comprising:

a baseplate; and a wall structure disposed on the baseplate, the wall structure defining a loudspeaker receptacle and a back volume;

a loudspeaker mounted on the loudspeaker receptacle and acoustically coupled to the back volume; and an acoustic insert according to claim 21 disposed in the back volume.

* * * * *